United States Patent [19]

Hada et al.

[11] 4,420,313

[45] Dec. 13, 1983

[54] METHOD FOR DUST REMOVAL FROM SOLID-GAS CONTACT REACTOR

[75] Inventors: Michio Hada; Yoshihiro Shiraishi; Masao Hino, Seto Toru, all of Hiroshima, Japan

[73] Assignee: Mitsubishi Jukogyo Kabushiki Kaisha, Hiroshima, Japan

[21] Appl. No.: 357,684

[22] Filed: Mar. 12, 1982

Related U.S. Application Data

[63] Continuation of Ser. No. 210,379, Nov. 26, 1980, abandoned.

[30] Foreign Application Priority Data

Nov. 26, 1979 [JP] Japan ..... 54-152684

[51] Int. Cl.[3] ..... B01D 46/04

[52] U.S. Cl. ..... 55/96; 55/294; 55/301; 422/178; 422/180; 423/239

[58] Field of Search ..... 422/178, 180, 222, 223; 423/239 A; 55/96, 282, 294, 301

[56] References Cited

U.S. PATENT DOCUMENTS 4,102,980 7/1978 Sasaki et al. ..... 423/239 A 4,210,427 7/1980 Brett et al. ..... 55/96

FOREIGN PATENT DOCUMENTS 52-28460 3/1977 Japan ..... 422/178

52-60273 of 1977 Japan .

*Primary Examiner*—Bernard Nozick

*Attorney, Agent, or Firm*—Wyatt, Gerber, Shoup, Scobey & Badie

[57] ABSTRACT

A method for dust removal from a solid-gas contact reactor for dust-laden exhaust gases which includes a packing section composed of packings each having a plurality of passages formed in the flow direction of the gases to be handled. Jets of gas for cleaning use are issued from a bank of stationary or movable nozzles installed in the reactor against the face at the inlet end of the packing section so as to blow off economically and efficiently the dust and other particulate matter that have settled from the gases on the packing section and have grown or bridged as a deposit thereon. The distance from the nozzles to the face of the packing section to be cleaned ranges from 0.2 to 1.0 meter, and the gas jet velocity at the inlet of the same section ranges from 5 to 40 m/sec.

6 Claims, 6 Drawing Figures

METHOD FOR DUST REMOVAL FROM SOLID-GAS CONTACT REACTOR

This is a continuation of application Ser. No. 210,379 filed Nov. 26, 1980, now abandoned.

This invention relates to a method for dust removal from a solid-gas contact reactor of the parallel gas flow type for the treatment of dust-laden, dirty exhaust gases, as for the denitrification and desulfurization of gases from a coal- or oil-fired boiler, coke oven, sintering furnace, or incinerator, the dust removal being done with means mounted in the reactor for periodically removing the dust deposit from the packings to maintain the packing capacity and minimize the pressure loss with the packings.

Problems common to the solid-gas contact reactors handling dirty exhaust gases are the tendencies toward increased pressure loss due to partial choking with the deposition of dust from the exhaust gases on the packing section and toward decreased catalyst action with the dust accumulation on the catalyst surface.

As a solution to these problems, reactors of the parallel gas flow type have been proposed which use grid- or honeycomb-shaped packings having a multiplicity of through holes in the gas flow direction.

The proposed type is said to fall into the category of "dust-free" solid-gas contactors in that the catalyst surface is disposed in parallel with the direction of the gas flow and is so scarcely subjected to the impingement of dust particles that practically no dust deposition takes place.

However, the dust particles impinge perpendicularly to the end face of the packing section at which the exhaust gases enter. With some sticky exhaust gas dust, it is sometimes the case that part of the dust will deposit, accumulate, and form bridges on the packing surface, even locally choking the section. Should this occur, the performance of the packing catalyst will deteriorate and the pressue loss with the packing section will increase to such an extent as to obstruct the operation of the equipment that constitutes the source of the exhaust gases. For these reasons periodic dust removal is a necessity.

Today, as the means of forcing away dust deposits during process operation, a number of modifications are under development to a method of using jets of steam, air, or other fluid directed against the entrance or exit of the packing section, specifically aimed at the dust deposit, accumulation, and bridges formed on the cleaning gas-inlet end of the packing section having a multiplicity of through holes aligned to the axis of the dirty gas flow (the method being hereinafter called the "soot blowing") (one of the modifications being proposed, for example, by Japanese Patent Application Public Disclosure No. 60273/1977). The method permits positive attainment of a dust removal effect. However, for a solid-gas contact reactor that handles an enormous volume of exhaust gases, as from a boiler, a great quantity of air under pressure of steam will be required to clean the entire gas-inlet surface having a large sectional area. An extensive search has been made, with this in view, for the conditions of effective soot blowing operation which would be economically feasible and have no adverse effect of blowing upon the packings. The search has led to this invention.

The present invention has for its object to provide an economical and effective soot blowing method based upon the discovery of the conditions for effectively removing the deposit, accumulation, and bridges of dust from the packing surface by providing jets of cleaning gas and sequentially directing them against the entire packing surface by use of a soot blower having a plurality of gas nozzles in a bank either kept stationary in the neighborhood of the inlet or the outlet at which the gas to be treated enters the packing section or held movably by a support carrying the nozzles and made movable at substantially right angles to the flow directon of the gas being treated. The optimum conditions have been arrived at after diversified experiments on the distance between the gas nozzles and the inlet of the packing section (hereinafter called the "blow distance") and also upon the flow velocity of cleaning gas jets at the inlet of the packing section.

The invention will be described in more detail below with reference to FIGS. 1 to 4 showing a soot blower having a plurality of circular nozzles for practicing the invention.

Figure 1:
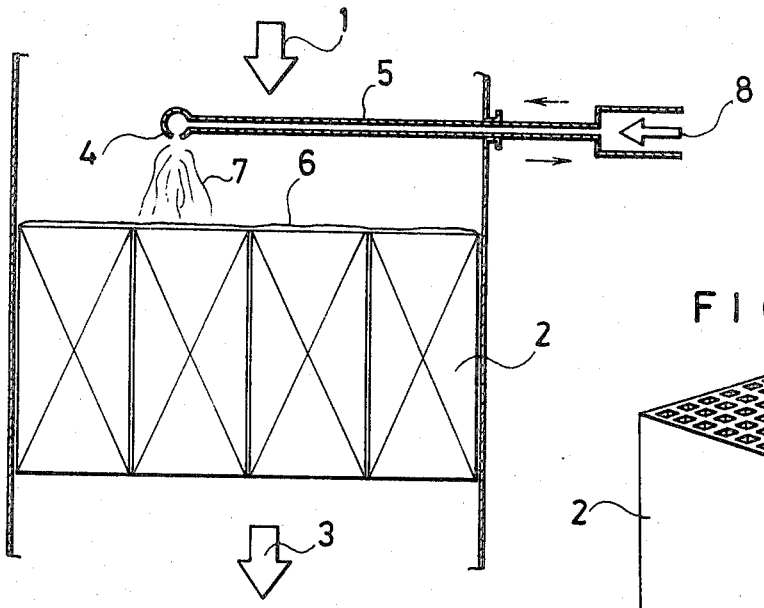
FIG. 1 is a schematic view of a solid-gas contact reactor equipped with a soot blower.
Figure 3:
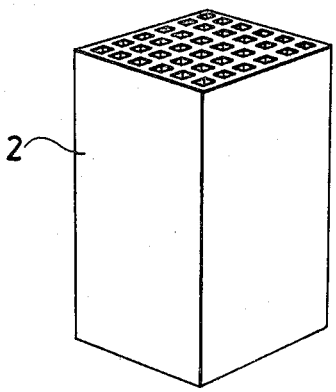
FIG. 3 is a perspective view of an example of packing to which the present invention is applicable.

Referring now to FIG. 1, the blank arrow 1 represents the exhaust gas to be treated in a vertical flow toward the inlet end of a packing section. The numeral 2 indicates the packing section and 3, the exhaust gas that has passed through the packing section wherein it has been purified by a solid-gas reaction. The packing section consists of packings each having gas passages in a grid, honeycomb, or other suitable formation as shown in FIG. 3. Usually, a plurality of such packings assembled in a package are held and installed in a duct. The numeral 4 denotes a circular nozzle constituting an essential part of the invention. A bank 5' of such nozzles are fixed to a support or lance tube 5, which is adapted to move sideways as viewed in FIG. 1, thus permitting the nozzles 4 to move in parallel with respect to the upper (or under) surface of the packing section 2.

Inside the packing section, oxides of nitrogen and sulfur are removed from combustion waste gas through solid-gas contact, for example, by reactions with a reducing agent supplied beforehand or by adsorption on the packing surface. Past the packing section 2, the gas is discharged from the system, now as clean gas 3 as mentioned above.

Meanwhile, the dust carried by the exhaust gas partly settles on the inlet end of the packing section and grows as a dust deposit 6.

Figure 2:
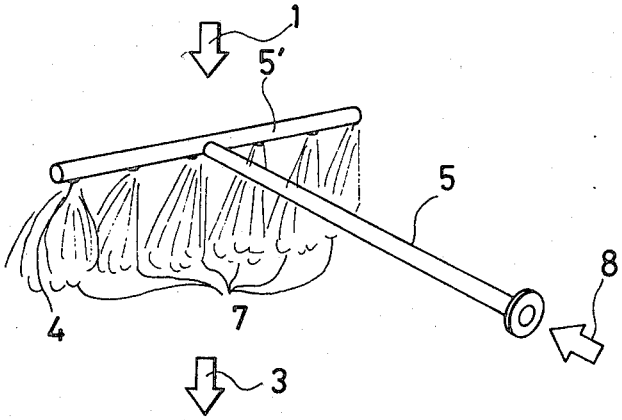
FIG. 2 is a perspective view of a soot blower having a plurality of circular nozzles.
Figure 4:
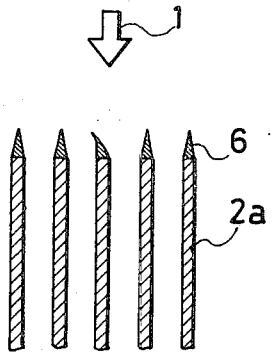
FIG. 4 is a view illustrating the growth of deposits on end portions of a packing.

A typical pattern of dust deposition is illustrated in FIG. 4. As shown, the caps of the dust deposit 6 formed on the tips of the inlet end grow counter to the gas flow direction 1 (or in the gas flow direction at the outlet end of the packing), and the grown caps tend to join and form partial bridges by dint of divagation of gas flow or for some other reason. The symbol 2*a* signifies a part of the packing shown in section. When an increase in pressure loss has resulted from the growth and bridging of the deposit, as shown in FIG. 2, a fluid 8, such as air or steam under pressure, is introduced from the outside into the lance tube 5 and thence the bank of circular nozzles 4 and is thereby jetted at an increased velocity against the deposit on the end face of the packing section to blow away, pulverize, and remove the deposit. Since the nozzle-supporting lance tube 5 is movable to the left and right as viewed in FIG. 1, soot blowing of the entire inlet or outlet face of the packing section, with a large sectional area, is feasible.

Number of said nozzles are such number that the jet width of nozzles are able to cover the upper (or under) surface of the packing section 2. Diameter of said nozzle is designed in accordance with a diameter of the gas passages of the packing section 2, a characteristic of the dust and the gas jet pressure.

Figure 6:
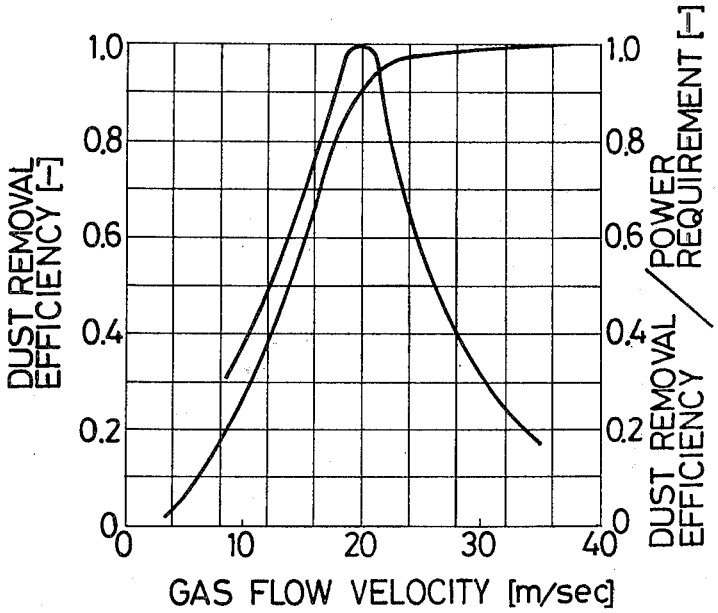
FIG. 6 is a graph showing results of experiments conducted on dust removal efficiency and gas flow velocity.

As a rule the diameter of a nozzle is suitable in the range from 2 mm to 20 mm. At the diameter less than 2 mm, it is unsuitable because a choking takes place, and in case more than 20 mm, it is uneconomical because a flow volume extremely increases. With the same apparatus and exhaust gas as used in Example 1, tests were made using a circular nozzles having diameter 2 mm, 10 mm and 20 mm respectively at a blow distance of 0.6 meter, in order to measure the flow velocity of air jets from the circular nozzles and the dust removal efficiency to be achieved. As the results, at the velocities 25–40 m/sec, the dust removal efficiency of 0.95 in FIG. 6 are obtained.

The shape of nozzle is a circular, an ellipse, and a rectangle, and at the velocity of more than 25 m/sec, the effects of said each type nozzles are almost same.

In case that the bank 5' of nozzles 4 is kept stationary, not shown in the drawings, the necessary number of said bank 5' are located in the neighborhood at the upper (or under) surface of the packing section 2.

The features of the invention will now be described in connection with examples of the invention.

With a solid-gas contact reactor of the parallel gas flow type for treating dirty exhaust gases from coal- and oil-fired boilers, various tests were conducted in accordance with the method of the invention for removing the deposit of dust from the inlet or outlet face of the packing section by means of jets of air, steam, or other fluid under pressure supplied from the outside through the circular nozzles as shown in FIG. 2.

EXAMPLE 1

Exhaust gas partly cleaned by a dust collector, i.e., the gas from a coal-burning boiler and having a composition (as determined at the outlet of the dust collector) as given in Table 1, was passed through a solid-gas contactor as illustrated in FIG. 1. After about 100 hours of operation, a flyash deposit as indicated in FIG. 4 was observed on the end face of the packing section.

TABLE 1

| Exhaust gas composition (at the outlet of the dust collector) | | | | | |
|---|---|---|---|---|---|
| $H_2O$ (%) | $CO_2$ (%) | NOx (ppm) | SOx (ppm) | Dust conc. (mg/Nm$^3$) | Temp. (°C.) |
| 10 | 2 | 270 | 1,450 | 70 | 350 |

Figure 5:
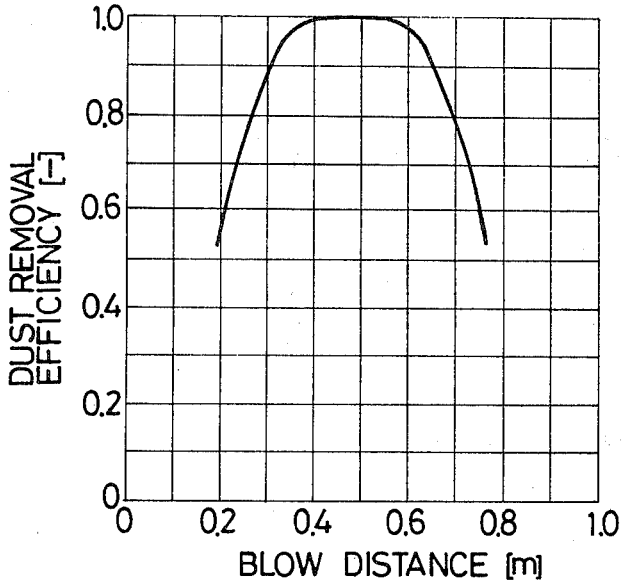
FIG. 5 is a graph showing results of experiments conducted on dust removal efficiency and blow distance.

Next, by means of a soot blower having circular nozzles with orifices about 5 mm in diameter, jets of air at a pressure of 4 kg/cm$^2$G were directed to the end face of the packing section at varied blow distances. The efficiencies achieved in those runs by the jets in removing the dust deposit from the end face were evaluated, and the data so obtained were plotted as in FIG. 5.

With the circular nozzles of the same orifice diameter using the same fluid under pressure, the jet width is generally proportional to the blow distance. As the distance from the nozzle tips to the inlet or outlet end of the packing section increases, the surface area against which the jets can be directed will be larger and the distribution of the gas flow velocity will become smoother, but the gas flow velocity itself will decrease. Conversely, the shorter the distance, the higher the flow velocity but the narrower the jet width will be. Thus, it has been found that there is a certain suitable range of blow distance for effective dust removal; a blow distance in the range from 0.2 to 1.0 meter, preferably from 0.3 to 0.8 meter, permits effective dust removal.

EXAMPLE 2

With the same apparatus and exhaust gas as used in Example 1, tests were made to increase the air pressure at a blow distance of 0.6 meter in order to clarify the relation between the flow velocity of air jets from the circular nozzles and the dust removal efficiency to be achieved. The results are graphically represented in FIG. 6.

As can be seen from the graph, a dust removal effect is observed at a gas flow velocity of about 4 meters per second. At the velocities over 25–30 m/sec, the dust removal efficiency reaches the ceiling. The flow velocity increases with the jet pressure, but a velocity in excess of 40 m/sec is no longer deemed favorable, when the possibility of rupture of the packings due to the impingement of gas upon the end face and the added power requirement for the increased jet pressure and gas flow rate are taken into consideration.

The power requirement is directly proportional to the gas flow rate and pressure. When dusting a given surface area, a low gas flow velocity (i.e., a low pressure) will reduce the dust removal efficiency; if an adequate efficiency is to be attained, more nozzles must be arranged in a closer pitch, consuming an increased overall quantity of the cleaning gas. On the other hand, a high gas flow velocity (i.e., a high pressure) will enhance the dust removal efficiency but again with a penalty of an increased gas flow quantity. Therefore, the optimum gas flow velocity should be chosen after careful consideration of the ratio of the intended dust removal efficiency to the power requirement.

It has been found that, as FIG. 6 indicates, the desirable gas flow velocity is in the range of 5–40 m/sec, more desirably in the range of 15–25 m/sec. At the pressure set to 4 kg/cm$^2$G, soot blowing operation was repeated 900 times in accordance with the invention. No deformation, rupture, or other change of the packings was observed after the runs. When steam was employed instead as the cleaning gas for soot blowing, similar dust removal efficiencies were recognized in relation to the gas flow velocities and blow distances used.

The present invention makes it possible to supply a cleaning gas at a flow velocity necessary and high enough to remove the dust that has settled, grown, and bridged on packings. It thus provides a practical, useful cleaning method whereby dust is economically and effectively removed from solid-gas contact reactors.

What is claimed is:

1. A method for removing dust particles from the packings of a solid gas contact reactor of the parallel gas flow type which includes a housing having a packing section including packing having a plurality of passages formed in the flow direction of a gas passing therethrough, said packing having upper and lower surfaces to prevent inhibiting the flow of gas through said passages in the packing due to accumulation of dust particles thereon which comprises an externally supplied cleaning gas through said passsages at a gas flow velocity of from 15 to 30 meters per second at the inlet of said packing section by passing said gases through a plurality of nozzles mounted in a stationary or movable bank near the inlet at which the gas enters the packing section, said bank when movable being movable at substantially right angles to the flowing direction of the gas through said nozzles, the number of nozzles being such that the cleaning gas issuing therefrom covers said upper, the diameters of said nozzles being from 2 mm to 20 mm, said nozzles being located at a distance of from 0.2 to 1.0 meter from the upper of said packing.

2. A method as in claim 1 wherein the gas velocity is from 15 to 25 meters per second.

3. A method as in claim 1 or 2 in which the cleaning gas is steam.

4. A method as in claim 1 or 2 in which the cleaning gas is air.

5. An apparatus for dust removal from the packings of a solid-gas contact reaction fo the parallel gas flow type which includes a housing having a packing section including packing having a plurality of passages formed in the flow direction of a cleaning gas passing therethrough, said packing having upper and lower surfaces which comprises a plurality nozzle mounted in a stationary or movable bank near the inlet at which the cleaning gas enters the packing section, said bank when movable being movable at substantially right angles to the flowing direction of the gas through said nozzle, the number of nozzles being such that a cleaning gas issuing therefrom covers said upper, the diameter of said nozzles being from 2 mm to 20 mm, said nozzles being located at a distance of from 0.2 to 1.0 meter from the upper of said packing, and means operatively connected with said nozzles for passing a cleaning gas therethrough at a velocity of from 15 to 40 meters per second.

6. An apparatus as in claim 5 wherein the distance of the nozzles from the inlet of the packing section is from 0.3 to 0.8 meter.

* * * * *